US008741006B2

(12) United States Patent
Russell et al.

(10) Patent No.: US 8,741,006 B2
(45) Date of Patent: Jun. 3, 2014

(54) ULTRA-HARD CONSTRUCTIONS WITH ENHANCED SECOND PHASE

(75) Inventors: Monte E. Russell, Orem, UT (US); Scott M. Packer, Alpine, UT (US); Russell J. Steel, Salem, UT (US); Ronald K. Eyre, Orem, UT (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 13/194,313

(22) Filed: Jul. 29, 2011

(65) Prior Publication Data

US 2011/0296765 A1 Dec. 8, 2011

Related U.S. Application Data

(62) Division of application No. 11/531,028, filed on Sep. 12, 2006, now Pat. No. 8,020,643.

(60) Provisional application No. 60/716,712, filed on Sep. 13, 2005.

(51) Int. Cl.

| | |
|---|---|
| ***B24D 3/00*** | (2006.01) |
| ***B24D 3/02*** | (2006.01) |
| *E21B 10/00* | (2006.01) |

(52) U.S. Cl.
USPC ..... 51/295; 51/307

(58) Field of Classification Search
USPC ..... 75/242, 243; 423/446; 51/295, 307; 451/48
See application file for complete search history.

(56) References Cited

U.S. PATENT DOCUMENTS

| | | | | |
|---|---|---|---|---|
| 4,148,964 | A * | 4/1979 | Fedoseev et al. | 428/403 |
| 4,664,705 | A * | 5/1987 | Horton et al. | 75/243 |
| 5,567,864 | A * | 10/1996 | Coon et al. | 73/1.81 |
| 8,061,458 | B1 | 11/2011 | Bertagnolli et al. | |
| 2005/0014454 | A1* | 1/2005 | Wrschka et al. | 451/41 |
| 2006/0042171 | A1* | 3/2006 | Radtke et al. | 51/307 |
| 2006/0266558 | A1* | 11/2006 | Middlemiss et al. | 175/426 |
| 2007/0079994 | A1* | 4/2007 | Middlemiss | 175/426 |

* cited by examiner

*Primary Examiner* — Pegah Parvini
(74) *Attorney, Agent, or Firm* — Osha Liang LLP

(57) ABSTRACT

An ultra-hard construction is disclosed that is prepared by a method comprising the steps of treating a material microstructure having a polycrystalline matrix first phase material and a second phase material from at least a partial region of the material microstructure, wherein the second phase material is disposed within interstitial regions of the material microstructure, and wherein removal of the second phase material creates a porous material microstructure characterized by a plurality of empty voids and replacing the removed second phase material with a replacement material having a thermal characteristic that more closely matched polycrystalline matrix first phase that the second phase material.

12 Claims, 5 Drawing Sheets

ULTRA-HARD CONSTRUCTIONS WITH ENHANCED SECOND PHASE

CROSS-REFERENCE TO RELATED APPLICATIONS

This patent application is a divisional patent application of U.S. patent application Ser. No. 11/531,028, filed on Sep. 12, 2006.

RELATIONSHIP TO COPENDING APPLICATION

This patent application claims priority of U.S. Provisional Patent Application Ser. No. 60/716,712 that was filed on Sep. 13, 2005, and which is incorporated herein by reference.

FIELD OF THE INVENTION

This invention relates to ultra-hard constructions and methods for forming the same, that are formed from ultra-hard materials such as polycrystalline diamond, polycrystalline cubic boron nitride, and mixtures thereof that have been modified to have an enhanced second phase that provides improved mechanical properties such as strength, and improved thermal characteristics when compared to conventional thermally stable ultra-hard constructions having a second phase material removed therefrom.

BACKGROUND OF THE INVENTION

The existence and use of ultra-hard materials in the form of polycrystalline material types for forming tooling, cutting and/or wear elements is well known in the art. Two polycrystalline material types, polycrystalline diamond (PCD) and polycrystalline cubic boron nitride (PcBN), are used for example as cutting elements to remove metals, rock, plastic and a variety of composite materials. Such known polycrystalline materials have a microstructure characterized by a polycrystalline matrix first phase, that generally occupies the highest volume percent in the microstructure and that has the greatest hardness, and a plurality of second phases, that are generally filled with a catalyst material that was used to bond or sinter the materials forming the polycrystalline matrix first phase.

For example, conventional PCD is formed by combining diamond grains (that will form the polycrystalline matrix first phase) with a suitable solvent catalyst material (that will form the second phase) to form a mixture. The mixture is subjected to processing conditions of extremely high pressure/high temperature, during which process the solvent catalyst material promotes desired intercrystalline diamond-to-diamond bonding between the grains, thereby forming a PCD structure.

Solvent catalyst materials typically used for forming conventional PCD include solvent metals from Group VIII of the Periodic table, with cobalt (Co) being the most common. Conventional PCD can comprise from about 85 to 95% by volume diamond and a remaining amount being the solvent metal catalyst material. The solvent metal catalyst material is present in the microstructure of the PCD material within interstices that exist between the bonded together diamond grains and/or along the surfaces of the diamond crystals.

The resulting PCD structure produces enhanced properties of wear resistance and hardness, making PCD materials extremely useful in aggressive wear and cutting applications where high levels of wear resistance and hardness are desired. Industries that utilize such polycrystalline materials for cutting, e.g., in the form of a cutting element, elements include automotive, oil and gas, aerospace, nuclear and transportation to mention only a few.

For use in the oil production industry, such PCD cutting elements are provided in the form of specially designed cutting elements such as shear cutters that are configured for attachment with a subterranean drilling device, e.g., a shear bit. Thus, such PCD shear cutters are used as the cutting elements in shear bits that drill holes in the earth for oil and gas exploration. Such shear cutters generally comprise a PCD body that is joined to substrate, e.g., a substrate that is formed from cemented tungsten carbide. The shear cutter is manufactured using an ultra high pressure/temperature process that generally utilizes cobalt as a catalytic second phase material that facilitates liquid phase sintering between diamond particles to form a single interconnected polycrystalline matrix of diamond with cobalt dispersed throughout the matrix.

The shear cutter is attached to the shear bit via the substrate, usually by a braze material, leaving the PCD body exposed as a cutting element to shear rock as the shear bit rotates. High forces are generated at the PCD/rock interface to shear the rock away. In addition, high temperatures are generated at this cutting interface, which shorten the cutting life of the PCD cutting edge. High temperatures incurred during operation cause the cobalt in the diamond matrix to thermally expand and even change phase (from BCC to FCC), which expansion is know to cause the diamond crystalline bonds within the microstructure to be broken at or near the cutting edge, thereby also operating to reduces the life of the PCD cutter. Also, in high temperature oxidizing cutting environments, the cobalt in the PCD matrix will facilitate the conversion of diamond back to graphite, which is also known to radically decrease the performance life of the cutting element. Additionally, the presence of cobalt in the polycrystalline matrix is also known to inhibit the ability of heat to be transferred away from the cutting edge of the cutter, because the coefficient of heat transfer for cobalt is approximately 100 W/mK as compared to diamond that is about 500-2600 W/mK.

Attempts have been made to address the above-noted limitations, associated with the presence of cobalt in the polycrystalline matrix, for the purpose of enhancing the service life of PCD cutting elements. For example, it is known to treat PCD to remove the cobalt or second phase material therefrom, which treatment has been shown to produce a resulting diamond body having enhanced cutting performance. One known for doing this involves at least a two-stage technique of first forming a conventional sintered PCD body, by combining diamond grains and a cobalt solvent catalyst material and subjecting the same to high pressure/high temperature process as described above, and then removing the solvent catalyst material therefrom, e.g., by acid leaching process.

However, the approach of removing the second phase cobalt from the polycrystalline diamond matrix creates the formation of voids or empty pores within the matrix surrounding the diamond crystals. The presence of such voids results in the formation of a porous structure that, while providing somewhat improved thermal expansion properties, now lacks strength and fracture toughness. In addition to the diamond structure lacking such physical properties, the presence of the voids within the microstructure act as insulation like empty air spaces, thereby impairing or reducing thermal heat transfer within the microstructure by relying on convective rather than conductive heat transfer within these voids.

It is, therefore, desirable that an ultra-hard construction be engineered in a manner that not only provides for improved properties of thermal stability, but that does so in a manner that does not sacrifice mechanical properties such as strength and fracture toughness. It is also desired that such ultra-hard constructions be engineered in a manner that provides improved thermal transfer characteristics when compared to conventional thermally stable PCD, by improving one or all of the thermal transfer mechanisms of conduction, convection and/or radiation within the material microstructure and/or construction.

SUMMARY OF THE INVENTION

Ultra-hard constructions of this invention are specially engineered having an ultra-hard material body that includes a first region that extends a desired distance from a body surface. The first region has a material microstructure comprising a polycrystalline matrix first phase and a second phase material interposed within the first phase. The first region is substantially free of a catalyst material that is used to form the polycrystalline matrix first phase.

The ultra-hard body also includes a second region that extends within the body a distance from the first region. The second region has a material microstructure comprising the polycrystalline matrix first phase and a catalyst material used to form the first phase disposed interstitially within the matrix. In an example embodiment, the second phase material in the first region is formed from a material having a thermal characteristic that is more closely matched to the matrix first phase than the catalyst material.

The ultra-hard body may or may not be joined to a substrate. Additionally, if desired, ultra-hard constructions of this invention can be configured so that the ultra-hard body does not include a second region, i.e., so that the entire ultra-hard body is substantially free of the catalyst material.

In an example ultra-hard construction, the second region comprises polycrystalline diamond, the polycrystalline matrix first phase comprises a plurality of bonded together diamond crystals, and the catalyst material is a solvent metal catalyst. Alternatively, the second region can comprise polycrystalline cubic boron nitride.

In an example embodiment, the thermal characteristic is radiative heat transfer, the second phase material is not a catalyst material, and the second phase material has an electromagnetic radiative spectra in the range of from about 0.1 to 100 micrometers. In another example embodiment, the thermal characteristic is conductive heat transfer, the second phase material is not a catalyst material, and the second phase material has thermal conductivity in the range of from about 0.1 to 2,300 W/mK. The second phase material can be selected provide a desired thermal characteristic that is both radiative and conductive.

Example second phase materials include those selected from the group of materials consisting of non-refractory metals, ceramics, silicon, silicon-containing compounds, diamond, cubic boron nitride, polycrystalline diamond, polycrystalline cubic boron nitride, and mixtures thereof.

Ultra-hard constructions of this invention can be constructed by forming a ultra-hard body, e.g., at high temperature/high pressure conditions, comprising a polycrystalline matrix phase and having an catalyst material disposed interstitially within the polycrystalline matrix phase. This ultra-hard body is then treated so that a region or the entire body is rendered substantially free of the catalyst material. The post-treated body is then treated so that the catalyst material is replaced with another material described above having a thermal characteristic that is more closely matched to the polycrystalline matrix phase than that of the catalyst material.

Ultra-hard constructions of this invention, prepared in accordance with the principles of this invention, are engineered in a manner that provides improved properties of thermal stability, and does so in a manner that does not sacrifice mechanical properties such as strength and fracture toughness. Ultra-hard constructions of this invention are engineered to display improved thermal characteristics, e.g., of convective, conductive and/or radiative heat transfer, when compared to conventional thermally stable PCD. Ultra-hard constructions of this invention are especially well suited for use as cutting elements attached to drill bits used for subterranean drilling, where improved properties of thermal stability and/or improved thermal characteristics are highly desired.

BRIEF DESCRIPTION OF THE DRAWINGS

These and other features and advantages of the present invention will be appreciated as the same becomes better understood by reference to the following detailed description when considered in connection with the accompanying drawings wherein.

DETAILED DESCRIPTION

Ultra-hard constructions of this invention have a material microstructure comprising a polycrystalline matrix first phase and an enhanced second phase that has been specially selected to provide a resulting construction having improved mechanical properties and thermal characteristics when compared to conventional ultra-hard constructions such as PCD and PcBN that have been treated to remove the second phase therefrom, e.g., for purposes of improving thermal stability. Ultra-hard constructions of this invention can be provided in the form of a compact comprising a substrate attached thereto to facilitate attachment of the construction to a desired tooling, cutting, machining, and/or wear device, e.g., a drill bit used for drilling subterranean formations.

As used herein, the term "PCD" is used to refer to polycrystalline diamond that has been formed at high pressure/high temperature (HPHT) conditions through the use of a metal solvent catalyst. Suitable metal solvent catalysts include, but are not limited to, those metals included in Group VIII of the Periodic table.

Figure 1A:
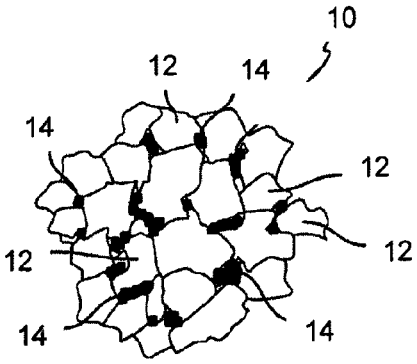
FIG. 1A is a schematic view of a region of conventional polycrystalline diamond.

FIG. 1 schematically illustrates a region of conventional PCD 10, comprising a plurality of bonded together diamond crystals 12, forming an intercrystalline diamond matrix first phase, and a solvent metal catalyst 14 that is interposed within interstitial regions between the bonded together diamond crystals and/or that are attached to the surfaces of the diamond crystals. As noted above, the presence of the solvent metal catalyst in this material microstructure is known to produce certain undesired thermally triggered effects within the structure when the microstructure is exposed to high temperatures, e.g., when used in certain aggressive cutting and/or wear applications, that can compromise the service life of an element comprising such material microstructure.

Ultra-hard constructions of this invention have a material microstructure that generally comprises a polycrystalline matrix first phase, and a plurality of second phases that are specially selected to both enhance the thermal characteristics of the material microstructure, reducing or eliminating the thermal expansion problems known to exist with the solvent metal catalyst material, and improve the strength of the overall microstructure when compared to a conventional PCD material that has been rendered thermally stable by simply removing the solvent metal catalyst therefrom.

Figure 1B:
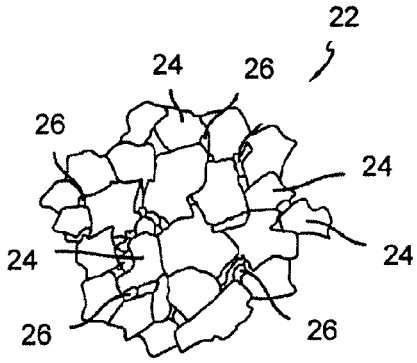
FIG. 1B is a schematic view of a first region of an example ultra-hard construction of this invention taken from FIG. 2C.
Figure 2A:
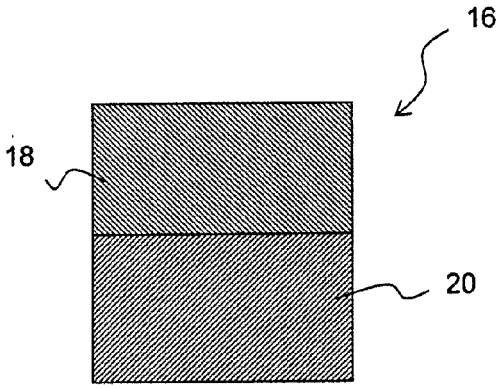
FIGS. 2A, 2B and 2C are cross-sectional schematic side views of an example ultra-hard construction of this invention during three different stages of formation.
Figure 2B:
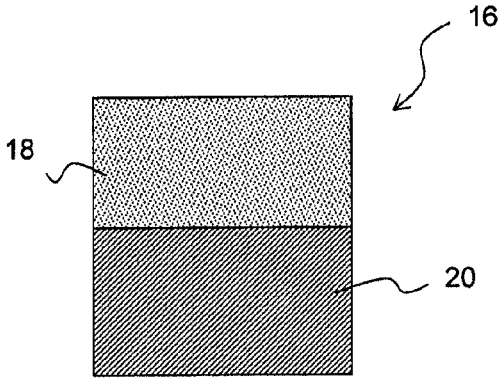
Figure 2C:
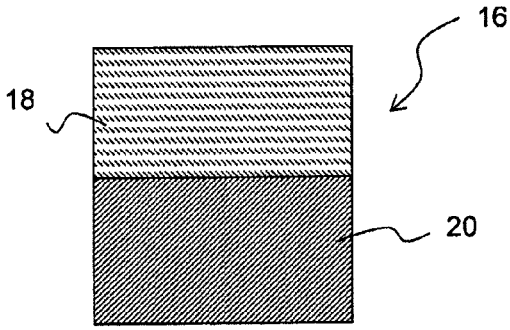

FIGS. 2A, 2B, and 2C each schematically illustrate an example embodiment ultra-hard construction 16 of this invention at different stages of formation. FIG. 2A illustrates a first stage of formation, starting with a desired ultra-hard material body 18, e.g., in the form of PCD or PcBN, in its initial form after sintering by the above-noted HPHT process. At this early stage, the ultra-hard material body 18 comprises a conventional polycrystalline matrix material. In an example embodiment, the polycrystalline matrix material forms a first phase of the material microstructure, and a second non-matrix material forms a plurality of second phases disposed within the interstitial regions of the material microstructure. In a preferred embodiment, the ultra-hard material body 18 is formed from PCD and the polycrystalline matrix material first phase comprises bonded together diamond crystals (shown as 12 in FIG. 1), and the second phase comprises a solvent catalyst binder material (shown as 14 in FIG. 1), e.g., cobalt, that is used to facilitate formation of the polycrystalline diamond matrix. The second phase material is disposed within interstitial regions between diamond crystals in the matrix and/or is attached to the surfaces of the diamond crystals.

As illustrated in FIGS. 2A, 2B, and 2C, the ultra-hard construction is provided in the form of a compact, comprising a substrate 20 attached to the ultra-hard material body 18. It is to be understood, however, the ultra-hard constructions of this invention can be provided without a substrate and that such ultra-hard construction embodiment is within the scope of this invention.

Accordingly, it is to be understood that ultra-hard constructions of this invention can be formed by using as a starting material such ultra-hard materials as conventional PCD and PcBN that are formed according to well known techniques, e.g., by HPHT sintering process. In an example embodiment, where the ultra-hard material is PCD, it can be formed by the HPHT process of sintering diamond grains. Diamond grains useful for forming PCD include synthetic or natural diamond powders having an average diameter grain size in the range of from submicrometer in size to 100 micrometers, and more preferably in the range of from about 5 to 80 micrometers. The diamond powder can contain grains having a mono or multi-modal size distribution. In the event that diamond powders are used having differently sized grains, the diamond grains are mixed together by conventional process, such as by ball or attrittor milling for as much time as necessary to ensure good uniform distribution.

The diamond powder may be combined with a desired solvent metal catalyst powder to facilitate diamond bonding during the HPHT process and/or the solvent metal catalyst can be provided by infiltration from a substrate positioned adjacent the diamond powder during the HPHT process in the event that an ultra-hard construction in the form of a compact is desired. Suitable metal solvent catalyst materials include those metals selected from Group VIII elements of the Periodic table. A particularly preferred metal solvent catalyst is cobalt (Co), Alternatively, the diamond powder mixture can be provided in the form of a green-state part or mixture comprising diamond powder that is contained by a binding agent, e.g., in the form of diamond tape or other formable/confirmable diamond mixture product to facilitate the manufacturing process. In the event that the diamond powder is provided in the form of such a green-state part it is desirable that a preheating step take place before HPHT consolidation and sintering to drive off the binder material. In an example embodiment, the PCD material resulting from the above-described HPHT process may have a diamond volume content in the range of from about 85 to 95 percent. For certain applications, a higher diamond volume content up to about 98 percent may be desired.

The diamond powder mixture or green-state part is loaded into a desired container for placement within a suitable HPHT consolidation and sintering device. In an example embodiment, where the PCD composite material is provided in the form of a compact attached to a substrate, a suitable substrate material is disposed within the consolidation and sintering device adjacent the diamond powder mixture.

In a preferred embodiment, the substrate is provided in a preformed state. Substrates useful for forming PCD ultra-hard materials, useful for forming ultra-hard constructions of this invention, can be selected from the same general types of materials conventionally used to form substrates for conventional PCD materials, including carbides, nitrides, carbonitrides, ceramic materials, metallic materials, cermet materials, and mixtures thereof. A feature of the substrate, when provided during HPHT processing for the purpose of providing an infiltrant, is that it include a metal solvent catalyst capable of melting and infiltrating into the adjacent volume of diamond powder to both facilitate conventional diamond-to-diamond intercrystalline bonding forming the PCD body, and to form a secure attachment between the PCD body and substrate. Suitable metal solvent catalyst materials include those metals selected from Group VIII elements of the Periodic table. A particularly preferred metal solvent catalyst is cobalt (Co), and a preferred substrate material is cemented tungsten carbide (WC-Co).

In an example embodiment, where the ultra-hard material is provided in the form of a compact, the container including the diamond power and the substrate is loaded into the HPHT device and the device is then activated to subject the container to a desired HPHT condition to effect consolidation and sintering of the diamond powder. In an example embodiment, the device is controlled so that the container is subjected to a HPHT process having a pressure of approximately 5,500 Mpa and a temperature of from about 1,350° C. to 1,500° C. for a predetermined period of time. At this pressure and temperature, the solvent metal catalyst melts and infiltrates into the diamond powder mixture, thereby sintering the diamond grains to form conventional PCD, and forming a desired attachment or bond between the PCD body and the substrate.

While a particular pressure and temperature range for this HPHT process has been provided, it is to be understood that such processing conditions can and will vary depending on such factors as the type and/or amount of metal solvent catalyst used in the substrate, as well as the type and/or amount of diamond powder used to form the PCD body or region. After the HPHT process is completed, the container is removed from the HPHT device, and the assembly comprising the bonded together PCD body and substrate is removed from the container.

FIG. 2B schematically illustrates an example embodiment ultra-hard construction 16 of this invention after a second stage of formation, specifically at a stage where the second phase material has been removed from at least a region of the ultra-hard material body 18. In the example embodiment noted above, where the ultra-hard material body 18 comprises a polycrystalline matrix first phase formed from bonded together diamond crystals, the second phase that is removed is the solvent metal catalyst such as cobalt. Referring to FIG. 1B, at this stage of making the construction, a region 22 taken from the ultra-hard material body 18 is shown to comprise the polycrystalline matrix first phase formed from a plurality of bonded together diamond crystals 24, and interstitial regions 26 that are substantially free of the second phase material.

As used herein, the term "removed" as used to refer to the modified presence of the second phase material in the ultra-hard material is understood to mean that a substantial portion of the second phase material no longer resides within the ultra-hard material. However, it is to be understood that some small amount of second phase material may still remain in the microstructure of the ultra-hard material within the interstitial regions and/or adhered to the surface of the diamond crystals. Additionally, the term "substantially free", as used herein to refer to the remaining ultra-hard material after the second phase material has been removed, is understood to mean that there may still be some small amount of second phase material remaining within the ultra-hard material as noted above.

The quantity of second phase material remaining in the material microstructure after the ultra-hard material has been subjected to a treatment to remove the same can and will vary on such factors as the efficiency of the removal process, or the desired amount of any second phase to be retained within the ultra-hard material. For example, it may be desired in certain applications to permit a small amount of the second phase material to stay in the ultra-hard material. In an example embodiment, it is desired that the ultra-hard material comprise no greater than about 1 percent by volume of the second phase material after removal.

In an example embodiment, the ultra-hard material is treated to render a region thereof or the entire body substantially free of the second phase material. This can be done, for example, by removing substantially all of the second phase material therefrom by suitable process. Example processes useful for removing the second phase material include chemical treatment such as by acid leaching or aqua regia bath, electrochemically such as by electrolytic process, by liquid metal solubility technique, by liquid metal infiltration technique that sweeps the existing second phase material away and replaces it with another during a liquid phase sintering process, or by combinations thereof. In an example embodiment, the second phase material is removed from all or a desired region of the PCD ultra-hard material by an acid leaching technique, such as that disclosed for example in U.S. Pat. No. 4,224,380, which is incorporated herein by reference.

In an example embodiment, where acid leaching is used to remove the second phase solvent metal catalyst, a portion of or the entire PCD ultra-hard material is immersed in the acid leaching agent for a sufficient period of time so that a desired depth extending from a designated surface, or the entire thickness of the ultra-hard material, is rendered substantially free of the second phase material.

In one example embodiment, the PCD ultra-hard material is subjected to acid leaching so that the entire material body is rendered substantially free of the second phase material, e.g., the solvent metal catalyst. In another example embodiment, the PCD ultra-hard material is subjected to acid leaching so that only a partial region of the body is rendered substantially free of the second phase solvent metal catalyst. For such partially treated embodiment, it is to be understood that the exact depth or thickness of the region rendered substantially free of the second phase that extends from an outer surface, e.g., a designated working surface, of the ultra-hard material can and will vary depending on the particular end use application.

For example, for end use applications that are not particularly aggressive, removal of the second phase material from a relatively lesser depth of the ultra-hard material extending from a working surface may provide a suitable improved level of thermal characteristics for use in such application. For end use applications that are more aggressive, removal of the second phase material from a relatively greater depth of the ultra-hard material extending from the working surface may be desired or necessary to achieve desired thermal characteristics compatible with use in such application.

As used herein, the term "thermal characteristics" is understood to refer not only to the thermal stability of the resulting construction, which can depend on such factors as the relative thermal compatibilities, e.g., thermal expansion properties, of the materials occupying the different construction material phases, but also the thermal heat transfer characteristics of the resulting constructions, which includes the heat transfer mechanisms of conduction, convection and radiation. A feature of ultra-hard constructions of this invention is that they are specially engineered having improved thermal characteristics when compared to conventional PCD that has been modified to have improved thermal stability by simply removing the catalyst material therefrom. More specifically, ultra-hard constructions of this invention are engineered having a second phase selected from materials that operate to provide an enhanced degree of thermal transfer through the construction, which improvement in thermal transfer is believed to be caused by improvements in the conductive and/or radiative heat transfer mechanism.

For example, in some applications it may be desired to have a region substantially free of the second phase that extends a depth of less than about 0.1 mm from a surface, e.g., a working surface, of the ultra-hard material, e.g., in the range of from about 0.02 to 0.09 mm, or from about 0.04 to 0.085 mm from the working surface. In other applications, it may be desired to have a region substantially free of the second phase that extends a depth from the working surface of at least about 0.1 mm or greater. It is to be understood that the exact depth of removing the second phase can and will vary on a number of different factors such as the volume content of the polycrystalline matrix first phase, and/or the size and type of ultra-hard materials used to form the same, and or the particular end use application.

FIG. 2C schematically illustrates an example embodiment ultra-hard construction 16 of this invention after a third stage of formation, specifically at a stage where the removed second phase material has now been replaced with a new material. In the example embodiment noted above, where the polycrystalline matrix first phase is formed from bonded together diamond crystals, and the second phase material that has been removed is a solvent metal catalyst such as cobalt, the new replacement material is preferably one that: (1) is relatively inert (in that it does not act as a catalyst relative to the polycrystalline matrix first phase); (2) enhances the mechanical properties of the construction; and (3) provides improved thermal characteristics within the construction. The ultra-hard material body at this stage of processing has a material matrix much like that illustrated in FIG. 1B, except that the interstitial regions 26 are filled with the replacement second material (e.g., the second phase material 14 in FIG. 1A has been removed and replaced with the replacement material).

Referring back to FIG. 2B, and FIG. 1B, once the second phase material is removed, the remaining polycrystalline matrix first phase 24 comprises a plurality of interstitial voids 26 forming what is essentially a porous material microstructure. This porous microstructure not only lacks mechanical strength, but the empty pores or voids 26 act as insulation to prevent a most effective mechanism of heat transfer within the material microstructure away from a cutting edge of the ultra-hard construction when placed into cutting use.

Replacing the second phase material removed from the polycrystalline matrix with the replacement material operates to fill the voids or pores 26, thereby mechanically strengthening and reinforcing the matrix first phase 24. Filling the voids with the replacement material also removes the empty pockets if air within the material microstructure, filling them with a material that facilitates heat transfer by conduction, rather than by convection, thereby operating to enhance the ability to effectively transfer heat away from the cutting edge of the construction.

The term "filled", as used herein to refer to the presence of the replacement material in the voids or pores of the ultra-hard material caused by the removal of the second phase, is understood to mean that a substantial volume of such voids or pores contain the replacement material. However, it is to be understood that there may also be a volume of voids or pores within the same region of the ultra-hard material that do not contain the replacement material, and that the extent to which the replacement material effectively displaces the empty voids or pores will depend on such factors as the particular microstructure of the ultra-hard material, the effectiveness of the process used for introducing the replacement material, and the desired mechanical and/or thermal properties of the resulting ultra-hard construction, which may be influenced to some degree by controlling the volume content of the replacement material within the material microstructure.

Suitable materials useful for replacing the removed second phase material include those that do not act as a catalyst to the ultra-hard material forming the polycrystalline matrix first phase to thereby minimize or eliminate the unwanted effects noted above known to occur in conventional PCD due to the presence of the catalyst material. Additionally, it is desired that the replacement material be one having a thermal expansion property is more closely matched to that of the material forming the polycrystalline matrix first phase as compared to that of the removed second phase. It is also desired that the replacement material be one having a thermal heat transfer property, e.g., by conductive and/or radiative mechanism, that operates to enhance the overall heat transfer characteristic of the material microstructure.

It is also desired that the replacement material have a melting temperature that is lower than that of the remaining polycrystalline matrix first phase. A desired feature of the replacement material is that it operates to enhance the strength of the matrix first phase, and that it also operates to improve the thermal characteristics of the resulting material microstructure. Another desired feature of the replacement material is that it display little shrinkage after being disposed within the matrix to prevent the formation of unfavorable resultant matrix stresses, while still maintaining the desired mechanical and materials properties of the matrix.

While the mechanism of conductive heat transfer is believed to play a role in achieving an improved thermal heat transfer property for ultra-hard constructions of this invention, the mechanism of radiative heat transfer is believed to play an equal or greater role. Until now, radiative heat transfer has not been considered as a principle mode of heat transfer in such ultra-hard constructions comprising, e.g., a polycrystalline diamond matrix first phase because polycrystalline diamond is considered an opaque material. Opaque materials only absorb, emit or reflect thermal radiation from the surface. Diamond is not believed to absorb thermal energy, rather diamond is believed to be a radiation transmitting material for almost the entire thermal radiation spectrum. Thus, it is desired that the replacement material be one selected that facilitates thermal heat transfer within the material microstructure by radiation, e.g., by transmission and/or reflection. The use of materials facilitating heat transfer through the microstructure by radiation, e.g., by reflection and/or transmission, will allow for heat at the working surface of the ultra-hard construction to be readily removed.

Materials useful for replacing the second phase material include those that are more thermally conductive and/or thermally radiative than that of the second phase material that has been removed from the material microstructure. In an example embodiment, it is desired that the replacement material be one having an electromagnetic radiative spectra in the range of from about 0.1 to 100 micrometers. Materials having a radiative spectra in this range are characterized as thermal radiators and are useful for the purpose of enhancing the thermal heat transfer characteristic of the ultra-hard construction by radiative thermal heat transfer mechanism.

In an example embodiment, it is desired that the replacement material be one that is not a catalyst and have a thermal conductivity in the range of from about 0.1 to 2,600 W/mK. Ideally, it is desired that the replacement material be one having both radiative and conductive heat transfer properties that most closely match that of the material forming the polycrystalline matrix first phase, e.g., polycrystalline diamond in a preferred embodiment.

Example replacement materials include, and are not limited to non-refractory metals, ceramics, silicon and silicon-containing compounds, ultra-hard materials such as diamond and cBN, and mixtures thereof. Additionally, the replacement material can be provided in the form of a composite mixture of particles and/or fibers. It is to be understood that the choice of material or materials used to replace the removed second phase can and will vary depending on such factors including but not limited to the end use application, and the type of material used to form the polycrystalline matrix first phase, and the desired mechanical properties and/or thermal characteristics for the same.

In an example embodiment, copper is a useful replacement material for its desired mechanical strength, and thermal properties of being a good thermal conductor and for being a good thermal radiator, thereby facilitating a desired improved heat transfer characteristic within the resulting ultra-hard construction.

Additionally, as mentioned above, mixtures of different materials can be used as the replacement material for the purpose of contributing certain desired properties and levels of such properties to the resulting ultra-hard construction. For example, in certain applications calling for a high level of thermal transfer capability and/or a high ultra-hard material density, a replacement material made from a mixture of a nonrefractory metal useful as a carrier, and an ultra-hard material can be used. In an example where the ultra-hard material comprises a polycrystalline diamond matrix first phase, a replacement material comprising a mixture of copper, e.g., in the form of copper powder, and diamond, e.g., in the form of ultra-fine diamond grains or particles, can be used to fill the removed second phase material by a liquid phase process as discussed in greater detail below.

In such embodiment, the mixture of copper and diamond grains or particles is placed adjacent the desired surface portion of the ultra-hard material after the second phase has been removed, and the assembly is subjected to HPHT conditions sufficient to cause the copper to melt and infiltrate the matrix, carrying with it the diamond grains or particles to fill the voids or pores in the polycrystalline diamond matrix. The use of an ultra-hard material as a component of the replacement material helps to both increase density of ultra-hard material in the resulting construction, and provides a further improvement in the heat transfer capability of the construction, by conductive and/or radiative means, when compared to one formed by using copper alone as the replacement material. Additionally, the presence of an ultra-hard material in the replacement material functions to provide the matching thermal expansion coefficients between the replacement second phase and the existing polycrystalline matrix phase, thereby enhancing thermal compatibility between these phases and reducing internal thermal stresses.

Accordingly, it is to be understood that this is but one example of how different types of materials can be combined to form a replacement material. Such replacement materials, formed from different materials, can be provided in the form of a single-phase alloy or can be provided having two or more material phases. Additionally, although the use of a replacement material in the form of a mixture has been described above in the context of filling using a liquid phase method, it is to be understood that replacement materials provided in the form of a mixture of two or more material can also be introduced into the ultra-hard material to fill the removed second phase material by solid state process such as that described below.

Different methods, in accordance with this invention, can be used to replace the removed second phase material. Example processes for introducing the replacement second phase material into the ultra-hard material to fill the voids formed from the removed second phase material include HPHT liquid phase processing, where the replacement material fills the voids via liquid phase infiltration. However, care must be taken to select a replacement material that when used to fill the removed second phase via liquid phase process displays little shrinkage during cooling to prevent unfavorable resultant matrix stresses while maintaining the desired mechanical and material properties of the matrix. Other processes include liquid phase extrusion and solid phase extrusion, induction heating, and hydropiller process.

The voids or pores left in the polycrystalline matrix by removing the second phase can also be filed by a suitable replacement material by use of a solid state process.

The following examples are illustrative of solid state and liquid phase processes that can be used to form ultra-hard constructions of this invention.

Solid State Filing—Friction Stir Process

According to a first method of filling, an ultra-hard material comprising the polycrystalline matrix first phase and having the second phase removed therefrom is provided in the form of a cutting element having a generally cylindrical body, and a working surface at one end of the body. The cutting element may or may not have a substrate attached to the ultra-hard material depending on the desired end use application. The cutting element is mounted at a slight angle in a spindle of a mill with the working surface exposed for contact with a desired replacement material, and the cutting element is rotated. In such embodiment, the second phase is removed from at least a region of the ultra-hard material that extends a depth from the working surface. As noted above, the cutting element is mounded in the spindle so that the working surface projects outwardly for making contact with a surface of a desired replacement material.

While the cutting element is rotated, it is plunged into a surface of the desired replacement material. In an example embodiment, the replacement material is copper, and in this solid-state process, the copper is provided in the form of a solid having a thermal conductivity of approximately 390 W/mK. The rotating cutting element is translated along an adjacent surface of the copper. In an example embodiment, the cutting element is provided at an angle, i.e., an approach angle, relative to the surface of the copper such that it does not plow the copper but traverses along the surface of the copper at a shallow approach angle, e.g., like a rock that is skipped across a water surface. In an example embodiment, the cutting element working surface is positioned relative to the copper surface at an approach angle of in the range of from about 0 to 90 degrees.

As the working surface of the cutting element is rotated against the surface of the solid copper replacement material, frictional heat is generated at the interface that increases the temperature of the copper just under the cutting element surface, thereby causing the copper to soften. As a load is applied between the cutting element surface and the surface of the copper, the softened copper is extruded ultra-hard material microstructure, thereby filling the voids within the polycrystalline matrix. In an example embodiment, a ½" diameter cutting element is rotated at approximately 450 RPM, traverses the copper surface at a speed of approximately 4 inches per minute, under a load of approximately 3,500 lbf imposed between the contacting surfaces of the cutting element and the copper. In an example embodiment, the process is conducted in an inert atmosphere, e.g., such as argon or nitrogen, to assist with the solid-state flow of the copper into the adjacent polycrystalline matrix microstructure and to minimize the formation of oxides.

The replacement second phase can be used to fill the entire depth of the removed second phase or only a partial depth extending from the working surface, depending on the particular end use application and desired properties of the resultant ultra-hard construction. In an example embodiment, for the purpose of providing a uniform degree of mechanical support and thermal properties within the polycrystalline matrix, it is desired that as much as possible of the removed second phase be filled with the replacement material.

When the selected replacement material is copper, it is preferred that the copper or copper alloy be provided in a form that will not melt and sweat out of the voids or pores of the cutting element during a later stage of using produced ultra-hard construction. For example, when provided in the form of a cutting element, such cutting element is oftentimes attached to a desired cutting device, e.g., a drill bit used for subterranean drilling, by brazing. Accordingly, for use in such applications, it is desired that the replacement material that is selected be one that will not sweat out of the voids during a subsequent brazing operation. Accordingly, in an example embodiment where copper is selected as the second phase replacement material, the copper preferably has a melting point that is higher than that of the braze material.

Alternatively, a lower melting replacement material, e.g., copper alloy, can be used to fill the voids in the ultra-hard material polycrystalline matrix if the friction stir process is carried out after any brazing process has been performed, e.g., after the cutting element has been brazed to the desired cutting device. In this situation, the friction stir process of filling the voids with solid copper is performed as described above, but with the exception that the solid copper or replacement material is rotated against the working surface of a relatively static and already mounted cutting element like a hydropillar process.

A feature of using this friction stir process is that because the replacement material, in this case copper, is only softened and not subjected to its melting temperature, it does not go through a phase change upon cooling, it maintains an ultrafine grain structure because of a short thermal cycle, and it exhibits superplastic flow behavior. A further advantage of using copper as the replacement material is that its relatively high thermal conductivity closely matches that of the diamond, and the low strength of the copper prevents excessive intergranular stresses in the diamond matrix. Additionally, copper makes intimate mechanical contact with the diamond in the polycrystalline matrix to provide additional support thereto by eliminating the voids and provides a conductive heat transfer means for more quickly and effectively removing heat from a cutting edge of the resulting ultra-hard construction.

Liquid Phase Filling—Re-Press Method

In an example embodiment, the ultra-hard material is treated to remove the second phase from a region of the material extending in the range of from about 0.07 to 0.085 mm from the working surface. The ultra-hard material was constructed in the form of a compact comprising a substrate attached to a surface of the ultra-hard material opposite from the working surface. In an example embodiment, the substrate was formed from a cermet material comprising a solvent metal catalyst. In a preferred embodiment, the substrate was formed from cemented tungsten carbide and the solvent metal catalyst was cobalt.

After removing the second phase material as noted above, the resulting ultra-hard material was again subjected to HPHT processing for a period of approximately 100 seconds at a temperature below that of the melting temperature of the solvent metal catalyst, e.g., cobalt, so that the solvent metal catalyst in the substrate and in the adjacent region of the ultra-hard material did not infiltrate back into the voids and pores created by the removal of the second phase material. Prior to initiating the HPHT process, a desired replacement material was positioned adjacent the working surface. In an example embodiment, the replacement material was provided in the form of a disk sized and shaped for placement over the working surface. The disk was formed from copper. When heated to its melting temperature during the HPHT process, the copper melted and infiltrated the ultr0hard material to fill the pores or voids therein.

As noted above, copper is but one choice of material useful for forming the replacement material from those materials noted above. Another material useful as a replacement material in this invention is silicon. An ultra-hard material having its second phase removed was filled with silicon according to the above-described HPHT process, wherein the silicon melted and infiltrated the ultra-hard material during the HPHT process to fill the voids or pores. While silicon does not provide the same thermal transfer benefits of copper, it does provide an improvement of thermal stability that also functions to enhance the service life of the ultra-hard construction comprising the same. Further, the use of silicone functions to provide an improvement in mechanical properties within the material microstructure resulting from reaction of the silicon with the polycrystalline matrix material and the resulting bond formed within the material microstructure by the reaction product. The presence of the reaction product and bond operates to strengthen and reinforce the microstructure matrix first phase.

Alternatively, the liquid phase filling method can also be used to fill the voids or pores in an ultra-hard material that has had its second phase material removed completely therefrom. In such example, the second phase material is removed from the entire ultra-hard material, i.e., in contrast to removing the second phase from only a region of the ultra-hard material extending a designated depth from the working surface. In an example where the ultra-hard material was PCD, and the second phase solvent metal catalyst is removed from the entire PCD body, the remaining material microstructure is essentially a polycrystalline diamond matrix that is substantially free of the solvent metal catalyst.

Such ultra-hard material, having its second phase completely removed therefrom, is again subjected to HPHT processing as described above, wherein during such processing a desired replacement material is positioned adjacent one or more of the surfaces of the ultra-hard material body to infiltrate and fill all or part of the voids or pores existing therein as a result of removing the second phase. If desired, the resulting ultra-hard construction, not including a substrate, can be brazed directly to the end use cutting device. Alternatively, at least a portion of the ultra-hard material can be filled with a brazable material during the HPHT process to facilitate the subsequent attachment of the resultant ultra-hard construction to a desired end use cutting device.

In a further alternative embodiment, wherein the ultra-hard material is as described above with the second material phase removed completely therefrom, a substrate can be attached or joined to the ultra-hard material during the HPHT process. In such an embodiment, a first HPHT operation would be conducted at a temperature sufficient to melt a relatively lower melting temperature replacement material to enable it to infiltrate and fill all or some of the voids or pores in the material, and a second HPHT operation would be conducted at relatively higher temperature to melt the solvent metal catalyst in the substrate to enable it to infiltrate into an adjacent region of the ultra-hard material to form an attachment therebetween. The resulting ultra-hard construction would be in the form of a compact having a substrate attached thereto.

In addition to these representative processes for introducing the replacement material into the voids or pores of the ultra-hard material microstructure, caused by the removal of the second phase, other processes can be used for introducing the replacement material. These processes include, but are not limited to chemical processes, electrolytic processes, and by electro-chemical processes.

As noted above, ultra-hard constructions of this invention can be formed by having the second phase material removed from a partial or total depth of the ultra-hard material body. FIG. 2C illustrates an ultra-hard construction embodiment where the second phase material has been removed from a partial depth of the ultra-hard material extending from the working surface, and where the replacement material has been used to substantially fill the voids resulting from such removal of the second phase. Alternatively, ultra-hard construction of this invention may include a replacement material that does not substantially fill the voids.

Figure 3:
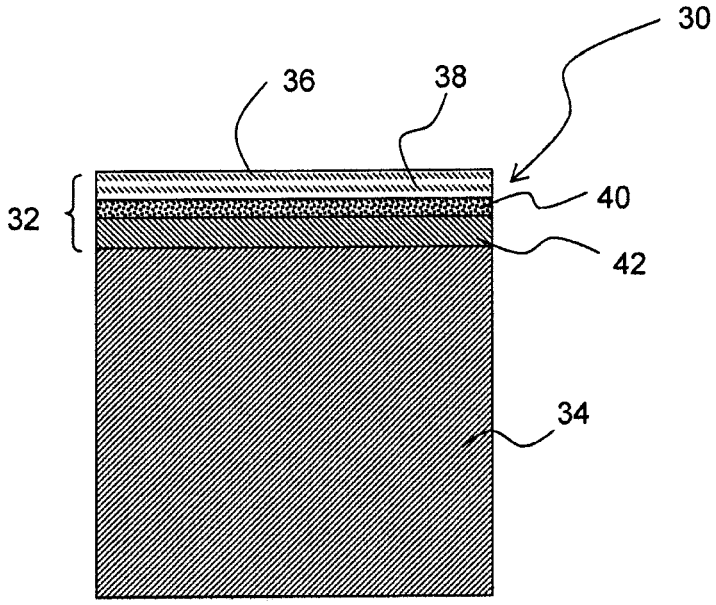
FIG. 3 is a cross-sectional schematic side view of an example ultra-hard construction of this invention having a partial portion of a removed second phase material filled with a replacement material.

FIG. 3 illustrates an embodiment of an ultra-hard construction 30 according to this invention that is provided in the form of a compact, comprising an ultra-hard material body 32 attached to a substrate 34. In this particular example, the second phase material was removed from a partial region of the ultra-hard material body 32 extending from a working surface 36, and the replacement material was used to partially fill the second phase removed region. The resulting ultra-hard construction 30 thus has an ultra-hard material body 32 comprising a first region 38 that extends a depth from the working surface 36 and that is filled with the replacement material, a second region 40 that extends a depth from the first region and that includes voids that are not filled with replacement material 38, and a third region 42 that extends from the second region to the substrate 20 that includes the second phase material. In an example embodiment where the ultra-hard material prior to second phase removal is PCD, all three regions comprise a polycrystalline diamond first phase, the first and second phases are substantially free of the solvent metal catalyst second phase, and the third phase includes the solvent metal second phase.

Figure 4:
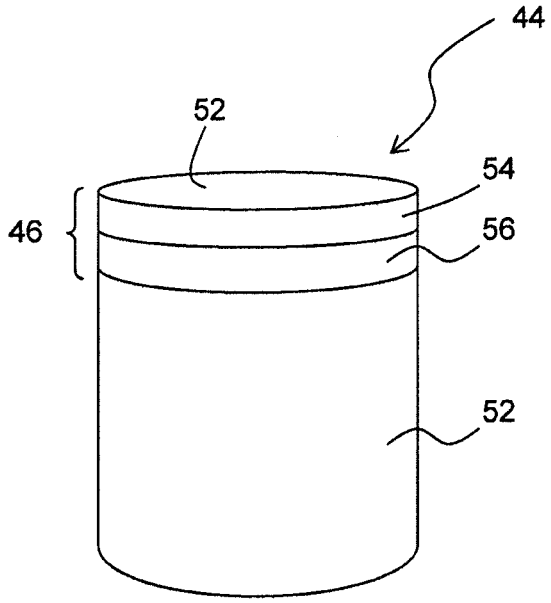
FIG. 4 is a perspective view of an example ultra-hard construction of this invention provided in the form of a compact.
Figure 5:
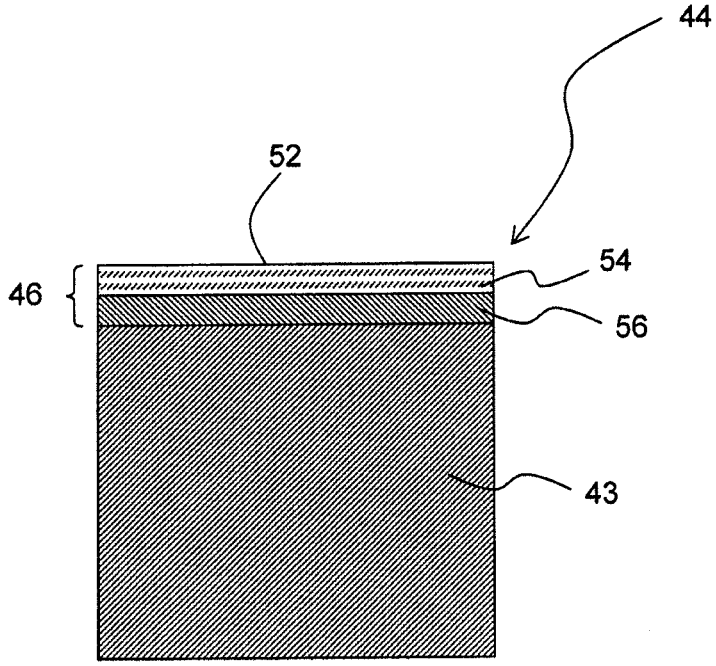
FIG. 5 is a cross-sectional schematic view of the ultra-hard construction compact of FIG. 4.

FIGS. 4 and 5 illustrate an embodiment of an ultra-hard construction 44 of this invention comprising a replacement material that completely fills the region of the ultra-hard material removed of the second phase material. The ultra-hard construction is provided in the form of a compact, comprising an ultra-hard material body 46 attached to a substrate 48. In this example, the second phase material was removed from a partial region of the ultra-hard material body 46 extending from a working surface 52, and the replacement material was used to completely fill the second phase removed region. The resulting ultra-hard construction 44 thus has an ultra-hard material body 46 comprising a first region 54 that extends a depth from the working surface 52 and that is filled with the replacement material, and a second region 56 that extends between the first region and the substrate, and that includes the second phase material. In an example embodiment, where the ultra-hard material prior to second phase removal is PCD, both regions comprise a polycrystalline diamond first phase, the first region 54 is substantially free of the solvent metal catalyst second phase, and the second region 56 includes the solvent metal second phase.

Figure 6:
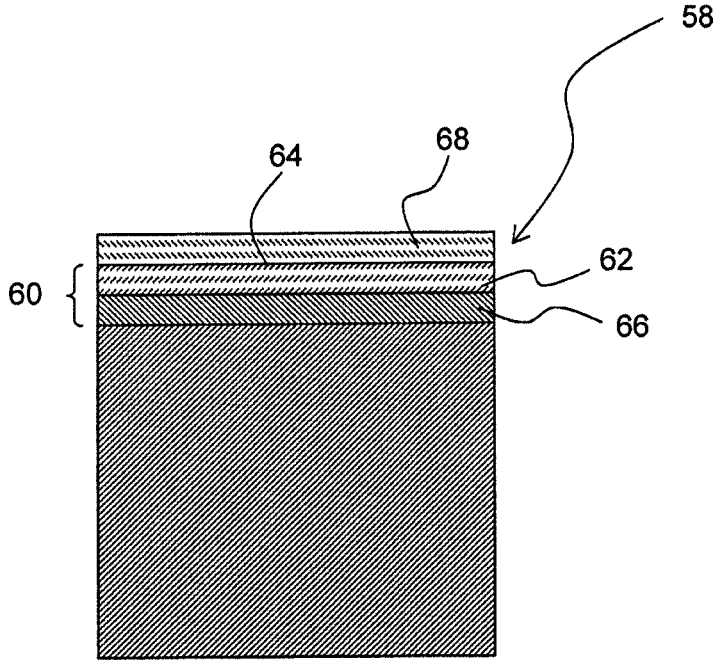
FIG. 6 is a perspective view of another example ultra-hard construction of this invention provided in the form of a compact.

FIG. 6 illustrates another embodiment of ultra-hard construction 58 of this invention, that is similar to that of FIGS. 4 and 5 in that it comprises an ultra-hard material body 60 including a first region 62 that extends a depth from a body surface 64 and that is filled with the replacement material, and a second region 66 that extends between the first region and the substrate, and that includes the second phase material. However, this construction embodiment additionally includes a surface layer 68 that is formed from a material having desired radiative heat transfer properties. In an example embodiment, the surface layer can be formed form the same types of materials described above for forming the replacement material.

In a preferred embodiment, the surface layer 68 is formed from a material having good thermal radiative properties to enhance thermal heat transfer away from an adjacent working surface of the construction during operation. In a preferred embodiment, the surface layer is formed from copper. The surface layer thickness can and will vary depending on a number of different factors such as the surface area of the ultra-hard material body, the type of material used to form the ultra-had material body, and the end use for the construction. In an example embodiment, the surface layer thickness can be greater than about 0.001 mm, and be in the range of from about 005 to 0.5 mm.

In addition to enhancing the heat transfer performance of the ultra-hard material, the surface layer can operate to impose a residual compressive stress on the underlying ultra-hard material body. As the surface layer wears away with the cutting edge or working surface during use, a portion of the surface layer remains and imposes a residual compressive stress onto the body to provide additional strength thereto.

Although the surface layer is shown in FIG. 6 as having a planar interface with the underlying surface of the ultra-hard material body, it is understood that the interface can also have a nonplanar interface, e.g., a convex or concave shaped interface, if desired. For example, it may be desired to have a nonplanar interface for the purpose of enhancing the surface area of contact therebetween, and/or for the purpose of enhancing heat transfer therebetween, and/or for the purpose of enhancing the degree of residual stress imposed on the ultra-hard material body. Additionally, the outside surface of the surface layer can be configured having a planar or nonplanar geometry.

Further, ultra-hard material constructions of this invention may comprise an ultra-hard material body made up of more than one ultra-hard material, e.g., made from a composite construction. For example, rather than being formed from a single PCD body, the ultra-hard material can be formed from a number of different PCD bodies that are joined together. Each body can be formed from the same or different materials. For example, PCD bodies can be used having different diamond volume contents or densities and/or being formed from differently sized diamond grains. Sill further, ultra-hard materials of this invention may comprise more than one surface layer disposed onto an ultra-hard material body, wherein such material layers can be formed from the same or different material to provide desired properties of thermal heat transfer, and/or residual compressive stress.

Ultra-hard constructions of this invention display marked improvements in service life when compared to conventional ultra-hard materials such as PCD that have been treated to have the solvent catalyst material removed from at least a region extending from the working surface.

For example, ultra-hard constructions prepared in accordance with the liquid phase process described above (formed from PCD having the voids, formed from the removed second phase solvent metal catalyst, filled with copper) have shown an improvement in performance (by mill test run length) of from 40 to 50 percent.

Ultra-hard constructions of this invention can be used to form wear and/or cutting elements in a number of different applications such as the automotive industry, the oil and gas industry, the aerospace industry, the nuclear industry, and the transportation industry to name a few. Ultra-hard constructions of this invention are well suited for use as wear and/or cutting elements that are used in the oil and gas industry in such application as on drill bits used for drilling subterranean formations.

Figure 7:
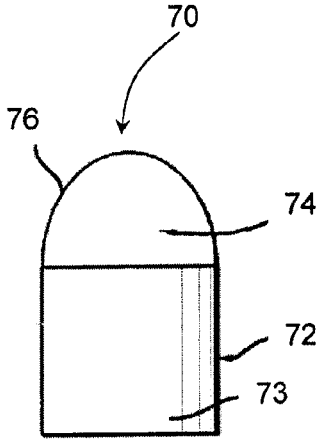
FIG. 7 is a perspective side view of an insert, for use in a roller cone or a hammer drill bit, comprising an ultra-hard construction compact of this invention.

FIG. 7 illustrates an embodiment of an ultra-hard construction compact of this invention provided in the form of an insert 70 used in a wear or cutting application in a roller cone drill bit or percussion or hammer drill bit used for subterranean drilling. For example, such inserts 70 can be formed from blanks comprising a substrate 72 formed from one or more of the substrate materials 73 disclosed above, and an ultra-hard material body 74 having a working surface 76 comprising a material microstructure made up of the polycrystalline matrix phase first phase and a replacement material disposed within voids formed from removal of the second phase. The blanks are pressed or machined to the desired shape of a roller cone rock bit insert.

Although the insert in FIG. 7 is illustrated having a generally cylindrical configuration with a rounded or radiused working surface, it is to be understood that inserts formed from ultra-hard constructions of this invention configured other than as illustrated and such alternative configurations are understood to be within the scope of this invention.

Figure 8:
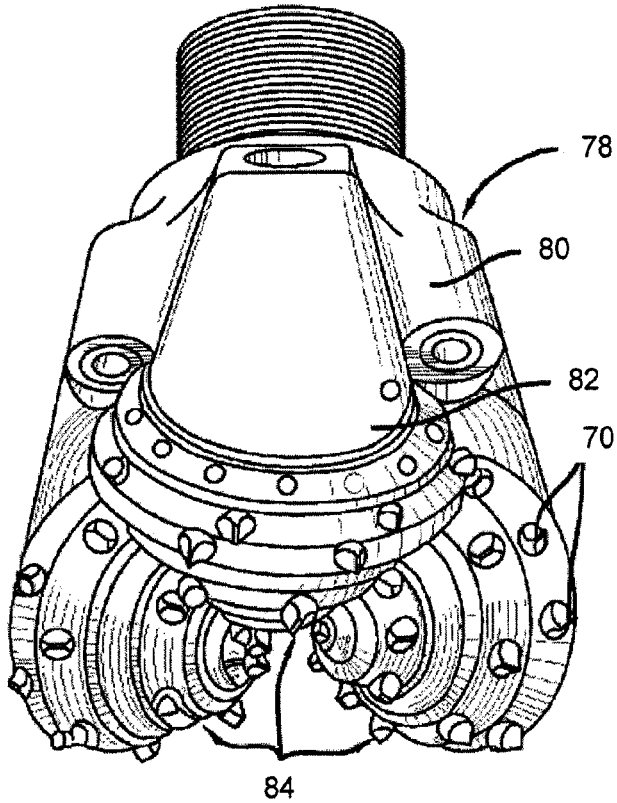
FIG. 8 is a perspective side view of a roller cone drill bit comprising a number of the inserts of FIG. 7.

FIG. 8 illustrates a rotary or roller cone drill bit in the form of a rock bit 78 comprising a number of the wear or cutting inserts 70 disclosed above and illustrated in FIG. 7. The rock bit 78 comprises a body 80 having three legs 82, and a roller cutter cone 84 mounted on a lower end of each leg. The inserts 70 can be fabricated according to the method described above. The inserts 70 are provided in the surfaces of each cutter cone 84 for bearing on a rock formation being drilled.

Figure 9:
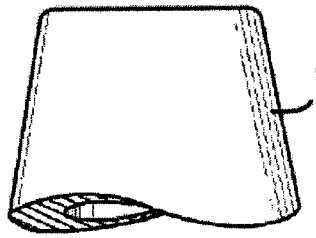
FIG. 9 is a perspective side view of a percussion or hammer bit comprising a number of inserts of FIG. 7.
Figure 9:
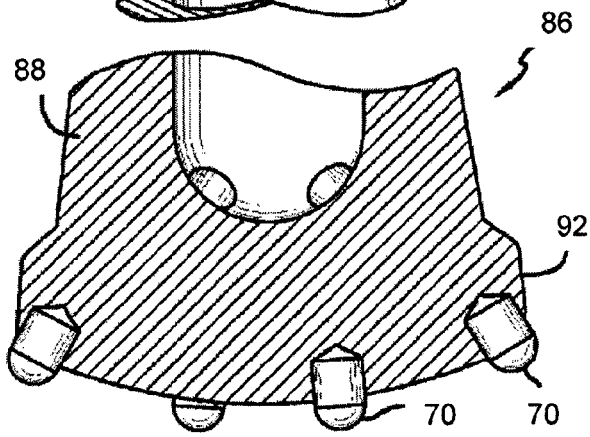

FIG. 9 illustrates the inserts 70 described above as used with a percussion or hammer bit 86. The hammer bit comprises a hollow steel body 88 having a threaded pin 90 on an end of the body for assembling the bit onto a drill string (not shown) for drilling oil wells and the like. A plurality of the inserts 70 is provided in the surface of a head 92 of the body 88 for bearing on the subterranean formation being drilled.

Figure 10:
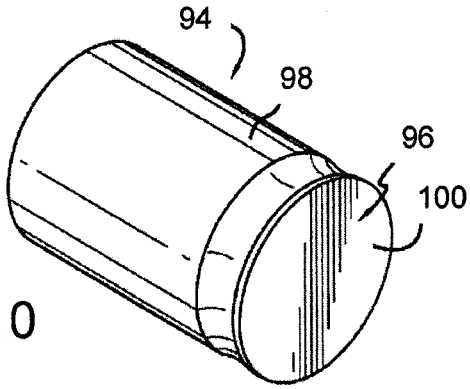
FIG. 10 is a schematic perspective side view of a diamond shear cutter comprising the ultra-hard construction compact of FIG. 4.

FIG. 10 illustrates an ultra-hard construction compact of this invention embodied in the form of a shear cutter 94 used, for example, with a drag bit for drilling subterranean formations. The shear cutter 94 comprises an ultra-hard material body 96, comprising the polycrystalline matrix first phase and the replacement material disposed within the voids formed from removing the second phase, attached to a cutter substrate 98. The ultra-hard material body 96 includes a working or cutting surface 100 having a material microstructure made up of the polycrystalline matrix phase first phase and the replacement material disposed within the voids formed from removal of the second phase.

Although the shear cutter in FIG. 10 is illustrated having a generally cylindrical configuration with a flat working surface that is disposed perpendicular to an axis running through the shear cutter, it is to be understood that shear cutters formed from ultra-hard constructions of this invention can be configured other than as illustrated and such alternative configurations are understood to be within the scope of this invention.

Figure 11:
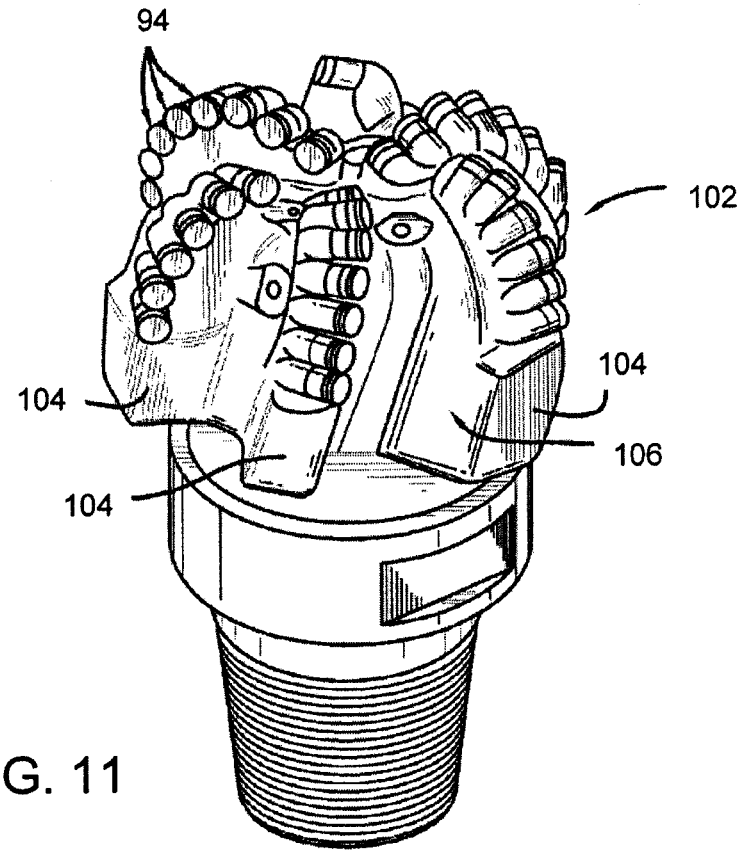
FIG. 11 is a perspective side view of a drag bit comprising a number of the shear cutters of FIG. 10.

FIG. 11 illustrates a drag bit 102 comprising a plurality of the shear cutters 94 described above and illustrated in FIG. 10. The shear cutters are each attached to blades 104 that each extend from a head 106 of the drag bit for cutting against the subterranean formation being drilled.

Other modifications and variations of ultra-hard constructions, compacts, and methods of forming the same according to the principles of this invention will be apparent to those skilled in the art. It is, therefore, to be understood that within the scope of the appended claims, this invention may be practiced otherwise than as specifically described.

What is claimed is:

1. An ultra-hard construction prepared by the method comprising the steps of:

treating a material microstructure comprising a polycrystalline matrix first phase material and a second phase material from a partial region of the material microstructure, wherein the second phase material is disposed within interstitial regions of the material microstructure, and wherein removal of the second phase material creates a porous material microstructure characterized by a plurality of empty voids;

replacing the removed second phase material with a replacement material having a thermal characteristic that more closely matches the polycrystalline matrix first phase than that of the second phase material;

wherein the partial region extends a depth from a working surface of the material microstructure wherein the replacement material is a composite mixture comprising a non-refractory metal and at least one selected from the group consisting of ceramics, diamond, cubic boron nitride, polycrystalline diamond, and polycrystalline cubic boron nitride.

2. The ultra-hard construction as recited in claim 1 wherein the material microstructure is formed from polycrystalline cubic boron nitride.

3. The ultra-hard construction as recited in claim 1 wherein during the step of replacing, the replacement material is introduced to fill a partial volume of the empty voids.

4. The ultra-hard construction as recited in claim 1 wherein the bulk of the replacement material has a melting temperature that is lower than that of the polycrystalline matrix first phase.

5. A method for making an ultra-hard construction comprising:

forming an ultra-hard body comprising a polycrystalline matrix phase and having catalyst material disposed interstitially within the polycrystalline matrix phase;

treating at least a partial region of an ultra-hard body comprising a polycrystalline matrix phase and a catalyst material disposed interstitially within the polycrystalline matrix phase so that the treated region is substantially free of the catalyst material;

replacing the catalyst material with a replacement material having a thermal characteristic that is more closely matched to the polycrystalline matrix phase than that of the catalyst material;

wherein the replacement material is a non-refractory metal or is a composite mixture comprising a non-refractory metal and at least one selected from the group consisting of ceramics, diamond, cubic boron nitride, polycrystalline diamond, and polycrystalline cubic boron nitride.

6. The method as recited in claim 5 wherein during the step of treating, only a partial region of the ultra-hard body is treated so that the body includes region that retains the catalyst material.

7. An ultra-hard construction prepared by the method comprising the steps of:

treating a material microstructure comprising a polycrystalline matrix first phase material and a second phase material from a partial region of the material microstructure, wherein the second phase material is disposed within interstitial regions of the material microstructure, and wherein removal of the second phase material creates a porous material microstructure characterized by a plurality of empty voids;

replacing the removed second phase material with a replacement material having a thermal characteristic that more closely matches the polycrystalline matrix first phase than that of the second phase material;

wherein the partial region extends a depth from a working surface of the material microstructure wherein during the replacing a first component of the replacement material melts and infiltrates into the polycrystalline matrix first phase material, thereby carrying a second component that does not melt into the polycrystalline matrix first phase material.

8. The ultra-hard construction as recited in claim 7 wherein the material microstructure is formed from polycrystalline cubic boron nitride.

9. The ultra-hard construction as recited in claim 7 wherein during the step of replacing, the replacement material is introduced to fill a partial volume of the empty voids.

10. The ultra-hard construction as recited in claim 7 wherein the bulk of the replacement material has a melting temperature that is lower than that of the polycrystalline matrix first phase.

11. The ultra-hard construction as recited in claim 7 wherein the first component comprises a non-refractory metal.

12. The ultra-hard construction as recited in claim 7 wherein the second component comprises at least one selected from the group consisting of ceramics, diamond, cubic boron nitride, polycrystalline diamond, and polycrystalline cubic boron nitride.

* * * * *